US007551145B2

(12) United States Patent
Tavassoli Hozouri

(10) Patent No.: US 7,551,145 B2
(45) Date of Patent: Jun. 23, 2009

(54) SLOT ANTENNA

(75) Inventor: Behzad Tavassoli Hozouri, Santa Clara, CA (US)

(73) Assignee: Wide Sky Technology, Inc., Hong Kong (CN)

( * ) Notice: Subject to any disclaimer, the term of this patent is extended or adjusted under 35 U.S.C. 154(b) by 105 days.

(21) Appl. No.: 11/759,801

(22) Filed: Jun. 7, 2007

(65) Prior Publication Data

US 2008/0136723 A1 Jun. 12, 2008

Related U.S. Application Data

(63) Continuation-in-part of application No. 11/608,371, filed on Dec. 8, 2006, now Pat. No. 7,394,435.

(51) Int. Cl.
*H01Q 13/10* (2006.01)

(52) U.S. Cl. ..... 343/770; 343/767

(58) Field of Classification Search ..... 343/767, 343/770, 700 MS

See application file for complete search history.

(56) References Cited

U.S. PATENT DOCUMENTS 5,202,697 A * 4/1993 Bonebright et al. ..... 343/770
6,646,618 B2 * 11/2003 Sievenpiper ..... 343/770
6,992,637 B2 * 1/2006 Hwang et al. ..... 343/770
7,091,920 B2 * 8/2006 Yuanzhu ..... 343/770

FOREIGN PATENT DOCUMENTS

WO 2006/136810 A1 12/2006

OTHER PUBLICATIONS

PCT Written Opinion of the International Search Authority in Int. App. No. PCT/US2007/086859 dated Oct. 31, 2008.
PCT International Search Report in Int. App. No. PCT/US2007/086859 dated Oct. 31, 2008.

* cited by examiner

*Primary Examiner*—Hoang V Nguyen
(74) *Attorney, Agent, or Firm*—Patent Venture Group; Raymond E. Roberts

(57) ABSTRACT

An antenna (10) having a top (14), a bottom (16), and a longitudinal axis (20). An outer shell (12) of electrically conductive material is provided which is coaxial with the longitudinal axis, and which includes an outer top wall (22) joining with an outer side wall (24) that extends toward the bottom of the antenna. The shell defines an interior region (18) that is filled with a dielectric material, and the shell has at least one slot (30) with opposed slot ends. Each slot extends from one opposed slot end in the side wall, and at least partially across the top wall to an opposed other slot end. A coaxial feed (32) extends from the bottom of the antenna to the top of the antenna, to convey electromagnetic energy to or from the top wall of the antenna.

20 Claims, 6 Drawing Sheets

SLOT ANTENNA

CROSS-REFERENCE TO RELATED APPLICATIONS

This is a continuation-in-part of application Ser. No. 11/608,371, filed Dec. 8, 2006, now U.S. Pat. No. 7,394,435, hereby incorporated by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Technical Field

The present invention relates generally to communications and radio wave antennas, and more particularly to slot type antennas.

2. Background Art

In numerous communication networks today it is required to establish communications between stations where at least one is mobile. Important requirements for antennas in such applications typically include having very wide beam coverage (ideally an omnidirectional pattern), compact structure, specific polarization type, and enough efficiency over a specific bandwidth. Cellular telephone handsets, satellite radio receivers, and global positional system (GPS) equipment are common examples of devices which impose such requirements. In fact, the latter usually needs an antenna with relatively more strict conditions, i.e., right-hand circular polarization and a very wide beam coverage pattern encompassing nearly the entire upper hemisphere. This is needed to allow a GPS receiver to maintain signal lock with and to track as many visible satellites as possible while also providing useful signal-to-noise and front-to-back ratios (that is, the radiation pattern has a substantially lower gain in the direction opposite to the direction of maximum gain).

One widely used option today for such applications is the patch antenna. However, these can require tradeoffs that are undesirable or unacceptable, especially in small or mobile applications. Generally, a patch antenna has a usefully low profile but this may be offset by the need for a large ground plane. A patch antenna therefore often cannot provide satisfactory performance where space is very limited. Patch antennas also do not provide good circular polarization over a very wide angular region and they tend to have poor gain at low angles of elevation, thus making them a poor choice for GPS applications. And patch antennas also do not provide a good front-to-back ratio.

Another candidate is the quadrifilar helical antenna (QFH), particularly in printed forms. Some of the advantages of the QFH antenna are its relatively compact size (compared to other known useable antennas such as crossed dipoles), its relatively small diameter, good quality of circular polarization (suitable for satellite communication), and its having a cardioid pattern, i.e., a main forward lobe which extends over a generally hemispherical region together with a good front-to-back ratio. The size of QFH antennas can also be reduced by dielectric loading or by shaping the printed linear elements. Unfortunately, QFH antennas require radiator lengths that are an integer multiple of one-quarter wavelength of the desired resonant frequency. Particularly for portable or mobile applications, this may require substantial miniaturization efforts to avoid having an overall antenna length that is longer than desired. The complexity of the feed system to obtain desired performance is often also an issue with QFH antennas.

Another prior art antenna is the slot type antenna. Slot antennas typically have a planar structure (sometimes somewhat curved) that includes at least one slot, and they are usually fed with microstrip lines or a coaxial feeder in the antenna cavity resonator. Although the performance of slot antennas is less dependent on the presence of a ground plane, the available slot antennas today have nearly all of the other shortcomings of patch antennas noted above. For example, the relatively large size required of the usual crossed slot antenna structure needed to create circular polarization is often undesirable. Cylindrical slot antennas have been designed to address some of these issues, but these have not been able to provide very wide beam coverage and tend to be relatively long. No simple feed system for these has been reported either.

Finally, in many communication networks antenna cost is a major concern. The cost of a suitable GPS antenna may be a trivial portion of the overall cost of an airline navigation system, but a cost-is-no-object approach is just not practical for antennas used in the communication networks that are becoming ubiquitous in our day-to-day lives. For example, in general consumer GPS, cellular telephone, and satellite radio, whether an antenna costs $0.20, $2.00, or $20.00 can be determinative of how a product is accepted in the marketplace.

Like most articles of manufacture, the cost of an antenna has two major components: the cost of the materials and the cost of fabricating those materials. It can therefore be productive here to view overall antenna suitability as having three major contributing factors. The first is antenna design, meaning here does this provide an antenna with adequate or better performance. A number of concerns related to this have been discussed above, and will be touched on further throughout this disclosure. The second factor is the materials-cost for an antenna design. This is considered least herein, since the materials typically differ little between different designs and because antenna designers tend to be very well schooled with respect to material-costs. The third factor is what the fabrication-cost of an antenna design. Some considerations here are which manufacturing technique is cheapest in terms of the machines used, the numbers and complexities of steps that these must perform, and the tolerances that equipment must be calibrated to and maintained at to achieve a desired yield. This last factor is one where much of the prior art is wanting.

BRIEF SUMMARY OF THE INVENTION

Accordingly, it is an object of the present invention to provide improved slot type communication antennas.

Briefly, one preferred embodiment of the present invention is an antenna having a top, a bottom, and a longitudinal axis. The antenna has an outer shell of electrically conductive material that is coaxial with the longitudinal axis, and that includes an outer top wall joining with an outer side wall that extends toward the bottom of the antenna. The shell defines an interior region that is filled with a dielectric material. The shell also has at least one slot with opposed slot ends, wherein each slot extends from one opposed slot end in the side wall at least partially across the top wall to another opposed slot end. A coaxial feed extends from the bottom of the antenna to the top of the antenna, to convey electromagnetic energy to or from the top wall of the antenna.

An advantage of the present invention is that it provides an antenna that is particularly suitable for mobile and handheld applications.

Another advantage of the invention is that it provides an antenna that can have a compact structure, and an antenna that can tradeoff between various dimensions to optimize that structure.

Another advantage of the invention is that it provides an antenna that is efficient at the frequencies of many important and emerging applications, and an antenna that is efficient across the bandwidths needed for such applications.

Another advantage of the invention is that it provides an antenna that can have suitable signal-to-noise and front-to-back ratios for many applications.

Another advantage of the invention is that it provides an antenna that can have wide beam coverage providing near-hemispherical radiation coverage approaching an omnidirectional pattern.

Another advantage of the invention is that it provides an antenna that employs a simple feed system able to provide desired features (e.g., antenna polarization) as applications require.

Another advantage of the invention is that it provides an antenna that can have linear or circular polarization over a wide angular range (e.g., right-hand circular polarization, beam width up to about 160 degrees, and with a suitable front-to-back ratio all as typically required for GPS and satellite radio applications).

And another advantage of the invention is that it provides an antenna suitable for simple fabrication, and therefore mass production and low cost production.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE SEVERAL VIEWS OF THE DRAWING(S)

The purposes and advantages of the present invention will be apparent from the following detailed description in conjunction with the appended figures of drawings in which.

Figure 1:
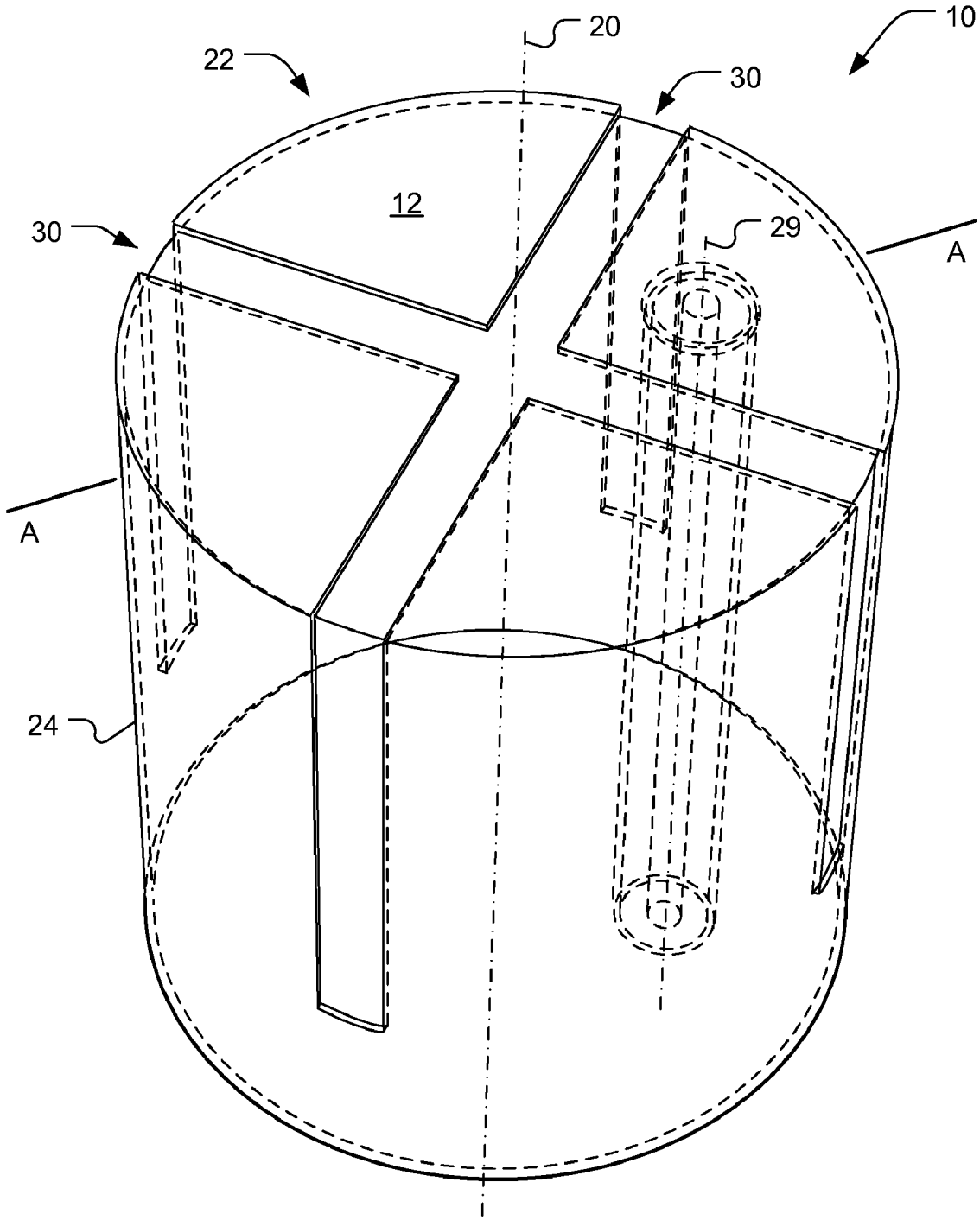
FIG. 1 is a perspective view of a slot antenna in accord with the present invention.
Figure 4A:
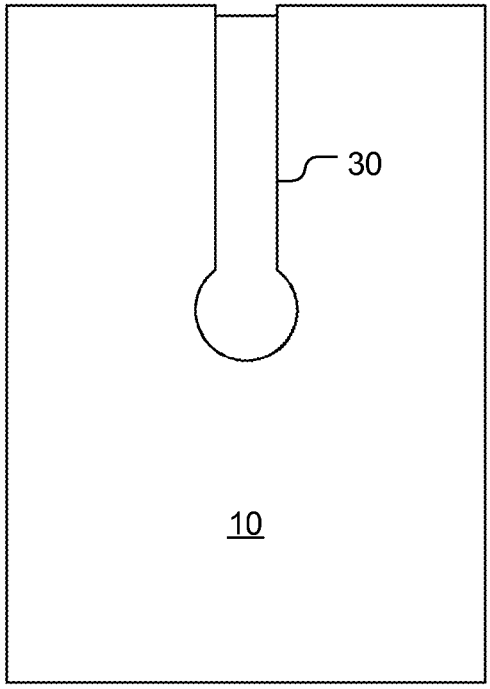
Figure 4B:
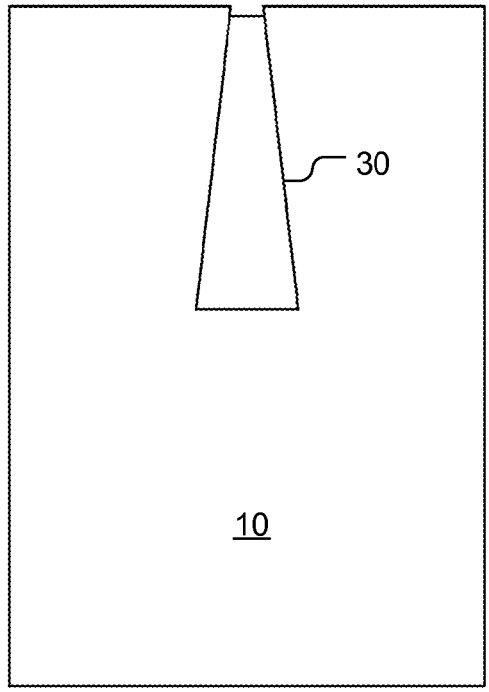
Figure 4C:
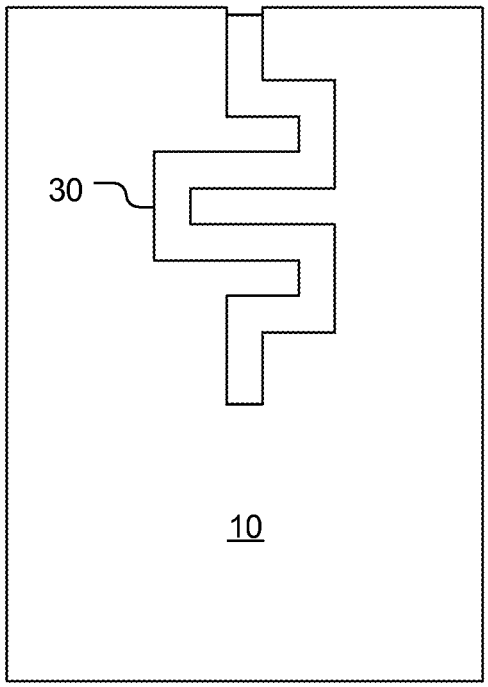
Figure 4D:
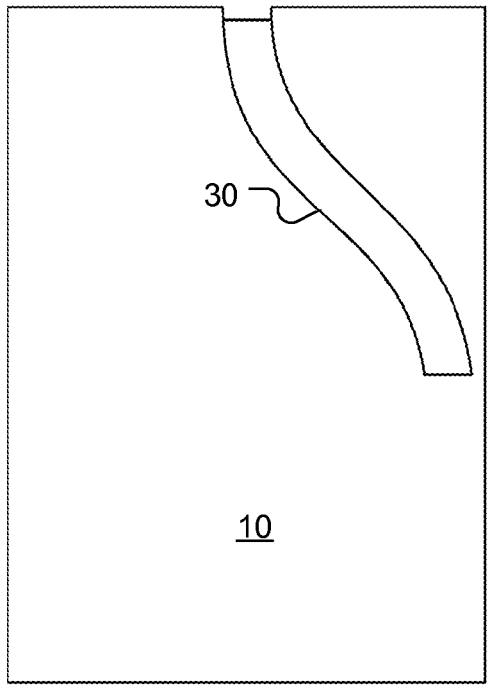
Figure 5:
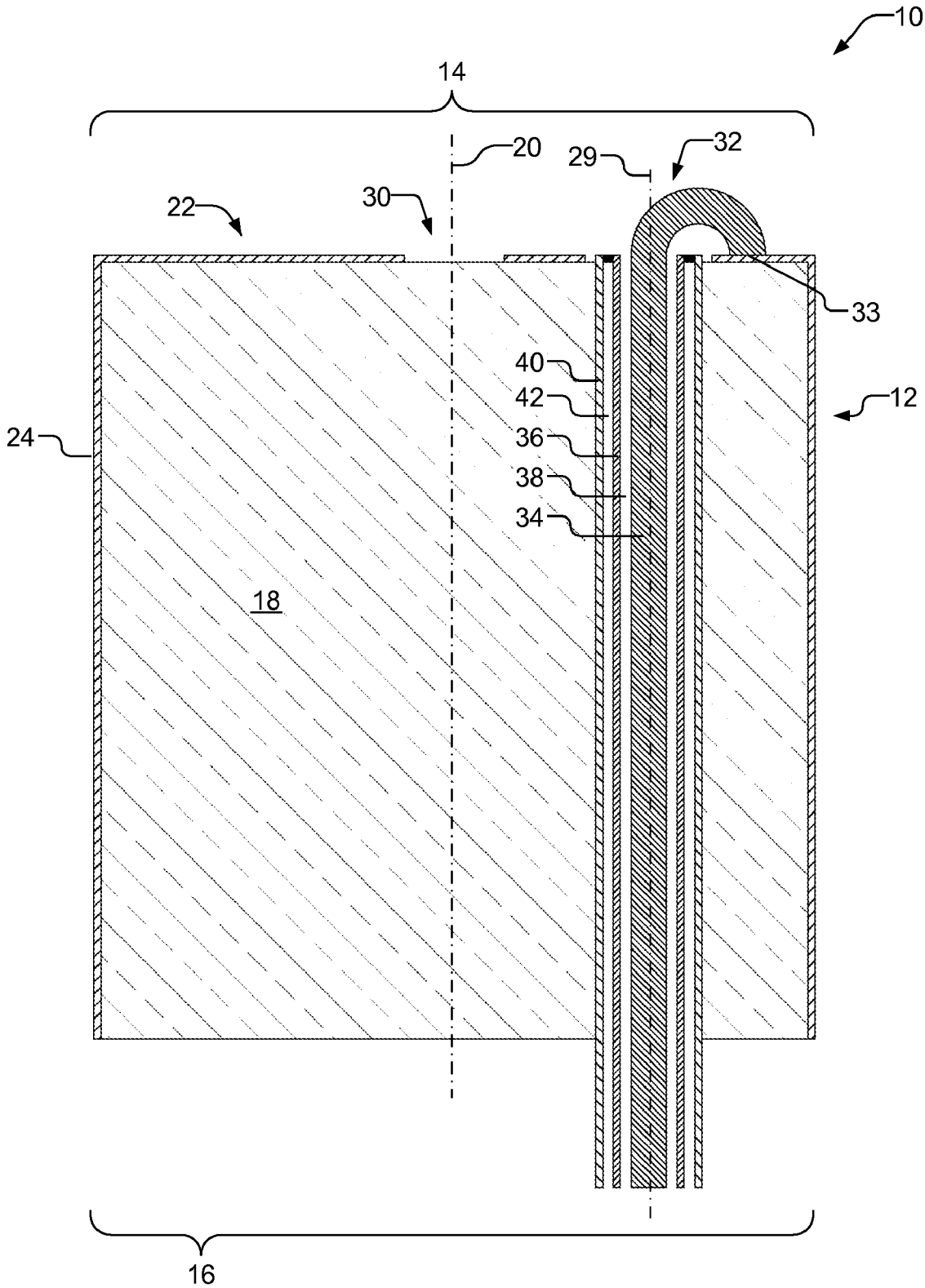
Figure 6:
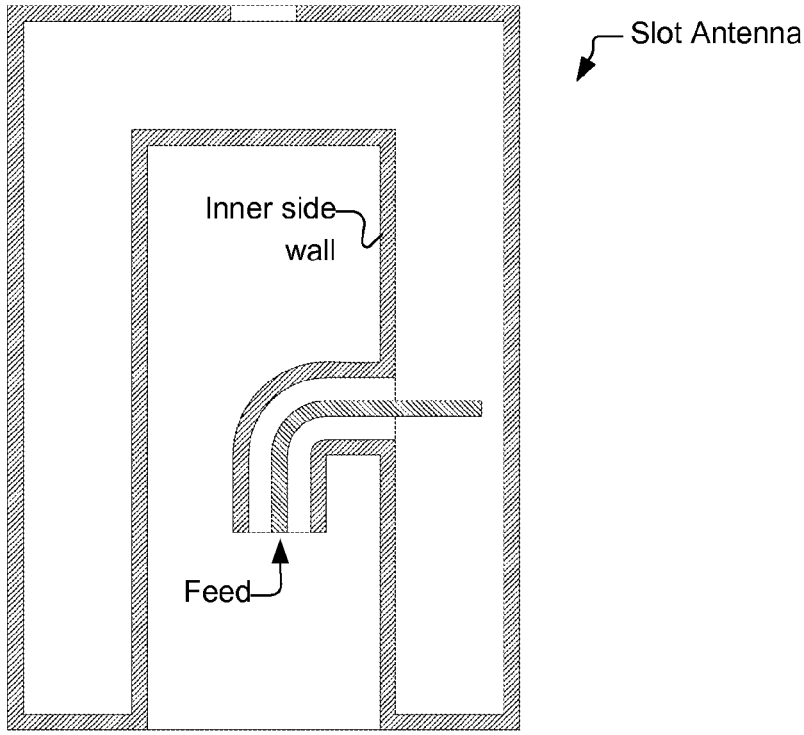
FIG. 6 (background art)
Figure 7:
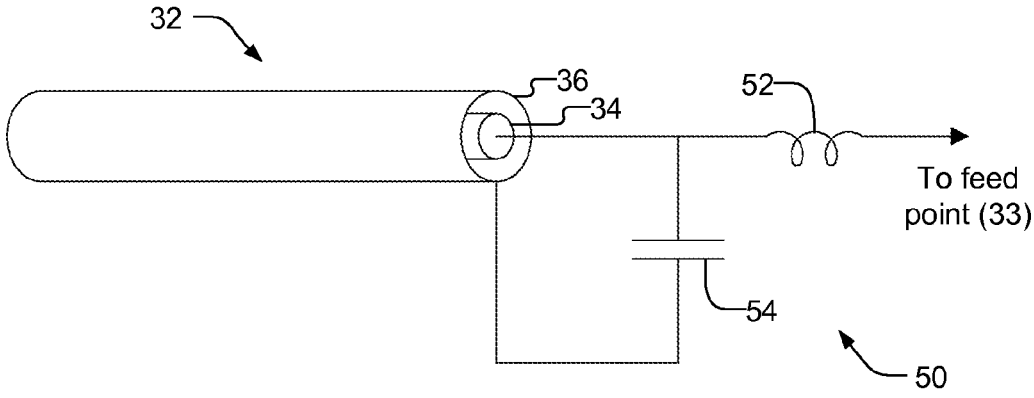

FIGS. 4*a-d* are side views of examples of slot antennas having different characteristics in the slots, wherein FIG. 4*a* shows a dumbbell-shaped slot, FIG. 4*b* shows a taper-shaped slot, FIG. 4*c* shows a meandered slot, and FIG. 4*d* shows a spiral-shaped and diagonally extending slot;

FIG. 5 is a cut away view (in principle, equivalent to the cross-sectional view taken along section A-A of FIG. 1) of an alternate cylindrical-shaped slot antenna that is also in accord with the present invention;

FIG. 6 (background art) is a cut away view of a slot antenna in accord with the teachings of the parent application, used here to show how the inner shield of FIG. 5 is physically different from the inner side wall of that antenna; and FIG. 7 is a schematic diagram of an equivalent circuit for a suitable matching network for use with the slot antennas of FIG. 1-3 or FIG. 5.

In the various figures of the drawings, like references are used to denote like or similar elements or steps.

DETAILED DESCRIPTION OF THE INVENTION

A preferred embodiment of the present invention is a slot type antenna. As illustrated in the various drawings herein, and particularly in the view of FIG. 1, preferred embodiments of the invention are depicted by the general reference character 10.

Figure 2:
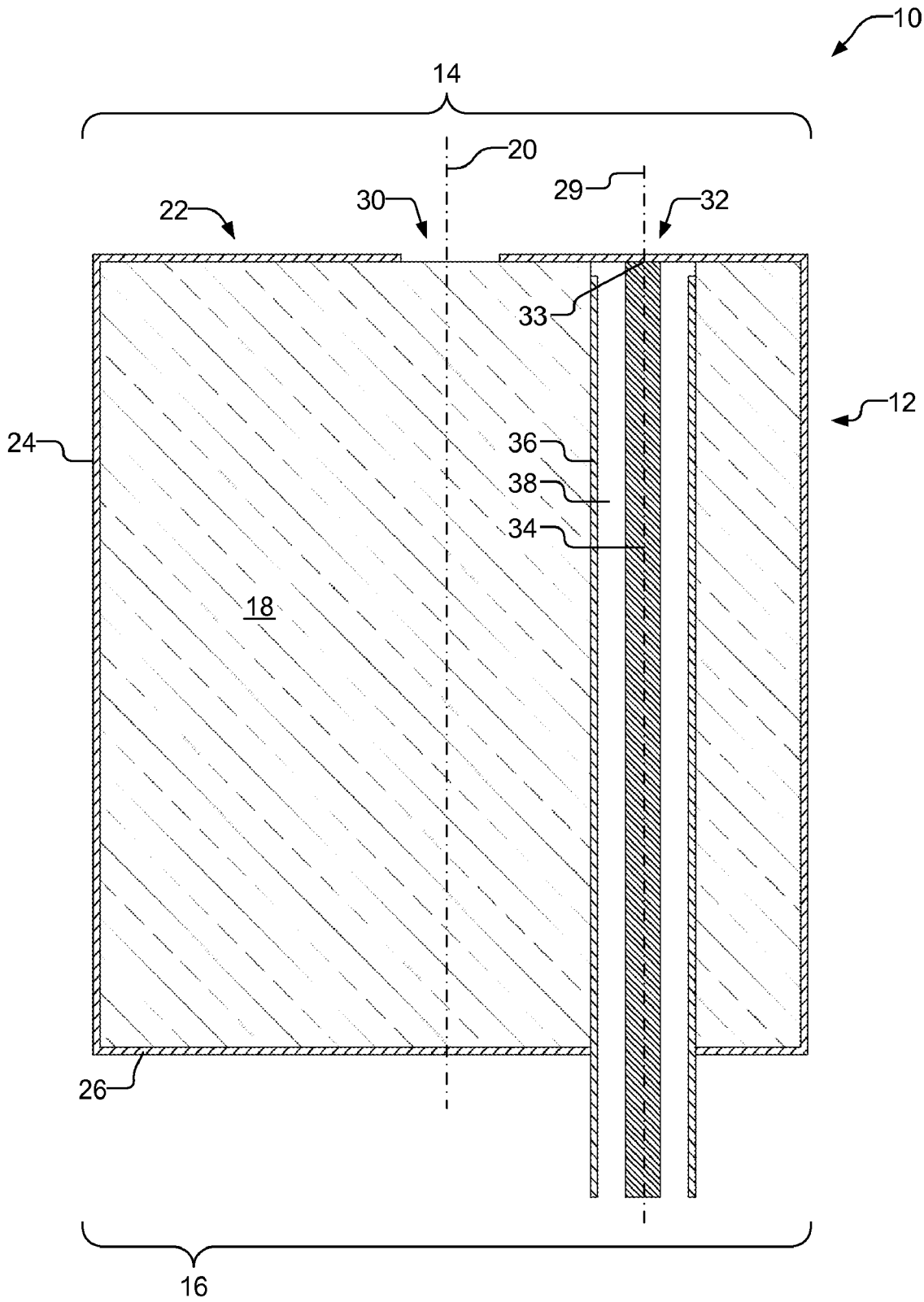
FIG. 2 is a cross-sectional view taken along section A-A of FIG. 1.

FIG. 1 is a perspective view of a slot antenna 10 in accord with the present invention, and FIG. 2 is a cross-sectional view taken along section A-A of FIG. 1. The slot antenna 10 has a shell 12, as well as a top 14, a bottom 16, an interior region 18, and a longitudinal axis 20 which are defined as shown with respect to the shell 12. The shell 12 here includes a top wall 22, a cylindrical shaped side wall 24, and an optional bottom wall 26.

The shell 12 is made of or has exterior surfaces that are covered by an electrically conductive material, such as copper. The interior region 18 is filled with a dielectric material, such as a low loss type like air, plastic, or ceramic. This dielectric material can also be homogenous or inhomogeneous, with an in homogeneity being due to multiple domains existing in the interior region with different dielectric constants. For instance, the dielectric can be of an artificial type and can be of a material with a particularly high dielectric constant which is normally a blend of a real dielectric material and metal particles, inclusions, or various inserts.

[N.b., herein the terms "exterior" and "interior" are used with respect to an element's influence on the electrical characteristics of the inventive slot antenna 10, and not necessarily with respect to their literal physical position with respect to inactive other elements. For example, rather than literally be outermost in all embodiments, the shell 12 may actually be inside a thin layer of nonconductive material, such as foam or plastic, that acts as a protective cover or radome. For instance, to facilitate manufacture the shell 12 may be deposited onto a more outward base material that provides physical support yet does not substantially alter how the slot antenna 10 performs. Such usage of relative terminology is common in this art and, in any case, should now be clear in view of this reminder.]

In the top wall 22 and in this embodiment extending into the side wall 24 of the shell 12, at least one slot 30 is provided. The example shown in FIG. 1 has two such slots 30 in a crossed-slot configuration with each having a length selected so that it resonates at a frequency that is the same as or which is close to the main application frequency or frequencies of the slot antenna 10. The extension of the slots 30 into the side wall 24 is not a requirement (e.g., one end of a slot 30 may be in the top wall 22 and the other in the side wall 24), but having the ends all in the side wall 24 may be desirable, especially to construct more compact embodiments of the slot antenna 10.

A single slot 30 is enough to produce linear polarization. Alternately, other embodiments of the inventive slot antenna 10 can provide other polarizations, as desired. For example, the slot antenna 10 can provide circular polarization if the two substantially orthogonal slots 30 radiate electromagnetic fields with substantially the same amplitude but a 90 degree phase difference.

A feed 32 is provided that electrically connects to the top wall 22 at a feed point 33. It has been the inventor's observation that the feed 32 acts mainly by connection here to the conductive top wall, thus acting largely externally rather than inside the interior region 18 of the slot antenna 10.

In most embodiments the feed 32 can simply be a coaxial transmission line that passes through the interior region 18, as shown in FIG. 1-2. The feed 32 here has a coaxial line inner conductor 34, a coaxial line outer conductor 36, and a coaxial line dielectric 38 (e.g., air). The position of the feed 32 and the connection of its coaxial line inner conductor 34 to the shell 12 at the feed point 33 can be determined through experiment, electromagnetic simulation, or just based on mechanical considerations for fabrication, such as minimum dielectric wall thickness. Normally, but not exclusively, the feed 32 can extend simply within the interior region 18, and then the feed 32 can itself have a longitudinal axis 29 that is eccentrically coaxial with the longitudinal axis 20 of the shell 12, as also shown in FIG. 1-2.

The terms "radiate" and "excite" can be used to refer to the inventive slot antenna 10 for both transmitting and receiving signals. The electrical characteristics of the slot antenna 10, such as its frequency response and radiation pattern, obey the reciprocity rule. Accordingly, if the slot antenna 10 is configured and tuned to radiate right hand circular polarization when excited, it can absorb a right hand circular polarized signal at the same frequency in the receiving mode.

A prior art approach that can be extended to the inventive slot antenna 10 is to differentiate the lengths of the two slots 30 by a specific amount. In this case, the shortest distance between the feed point 33 and the two slots 30 needs to be approximately equal. The slightly different slot lengths then cause the slots 30 to resonate at two different frequencies, and the phase of each then varies with respect to the actual frequency present. By appropriately tuning the lengths of the slots 30 a fixed phase offset for each is obtained, and a predetermined total phase difference between the slots 30 can then be provided at a desired specific frequency, i.e., the main application frequency of the slot antenna 10.

Such dual-resonance techniques using the feed system for circular polarization are relatively simple and help make circular polarized embodiments of the slot antenna 10 cheaper to manufacture. This structure also makes it possible to have more optimal tradeoffs between antenna diameter (horizontal extent) and antenna profile (vertical extent) for specific applications. This can create circular polarization over a very large angular region (e.g., about +/− 50 degrees in both planes).

As is known in the art, double resonance methods of creating circular polarization generally produce relatively narrow bandwidths. In contrast, the inventive slot antenna 10 can be designed to have a fairly low VSWR over a wider bandwidth. Thus it can have a mixed linear polarization in frequencies other than the circular polarization narrow bandwidth, and it therefore can be used for specialized applications, e.g., mobile applications, which need both circular polarization and mixed linear polarization albeit in different portions of their total bandwidths.

Many other known prior art techniques can also be applied to further improve the inventive slot antenna 10. For example, other shapes can be utilized for the slots 30. This can provide various benefits, with increased bandwidth and reduced size being two common ones.

Figure 3:
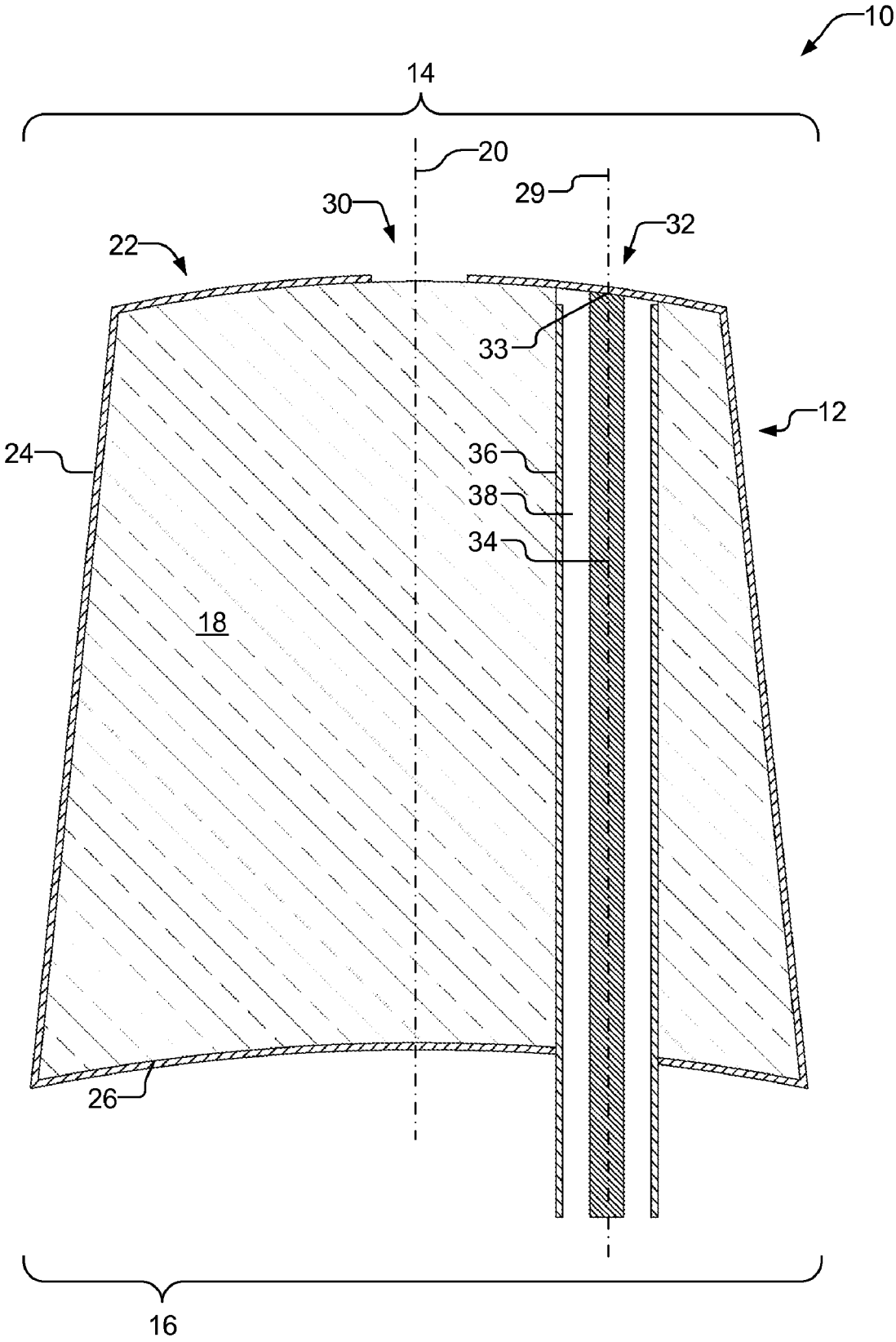
FIG. 3 is a cut away view (in principle, equivalent to the cross-sectional view taken along section A-A of FIG. 1) of an alternate cone-shaped slot antenna that is also in accord with the present invention.

FIG. 3 is a cut away view (in principle, equivalent to the cross-sectional view taken along section A-A of FIG. 1) of an alternate cone-shaped slot antennas 10 that is also in accord with the present invention. Here the slot antenna 10 has a conically shaped side wall 24, a convex or "dome" shaped top wall 22, and an (optional) concave shaped bottom wall 26. FIG. 3 thus further shows the variation in the range of possible embodiments of the inventive slot antenna 10. Using any or all of these variations may be done, for instance, to alter the electrical characteristics of the slot antenna 10 (e.g., to broaden its bandwidth response characteristics), to make an embodiment aesthetically pleasing, or to deal with application-specific constraints (e.g., to conform the shaped bottom wall 26 with a mounting surface).

FIGS. 4*a-d* are side views of examples of slot antennas 10 having different characteristics in the slots 30. FIG. 4*a* shows a dumbbell-shaped slot 30, FIG. 4*b* shows a taper-shaped slot 30, FIG. 4*c* shows a meandered slot 30, and FIG. 4*d* shows a spiral-shaped and diagonally extending slot 30. [N.b., the example here is nominally spiral-shaped, but that is not a requirement. A slot 30 could have a different curvature or even extend linearly and diagonally in the side wall 24.] Although the examples in FIGS. 4*a-d* have single slots 30, it also should be noted that embodiments of this invention may have any number of slots 30, with these and other possible shapes.

Another prior art technique that can be extended to the inventive slot antenna 10 is to load the slot antenna 10 with low loss plastic or ceramic material with high dielectric constant to improve the mechanical stability and/or reduce the size of such a slot antenna 10 compared to that of a slot antenna 10 with air as the dielectric.

When embodiments of the slot antenna 10 are dielectric loaded, they can be made by conventional photoetching techniques. This is particularly useful for a fully dielectric loaded slot antenna 10 (versus a partially loaded embodiment). For example, first the interior region 18 of a dielectric material is provided. Then a metallization procedure is used to coat the surfaces of this with what will ultimately become the shell 12 of the slot antenna 10. Next portions of the metallized surface is partially removed in a predetermined pattern to produce the final shell 12, particularly including the one or more slots 30.

Yet another prior art technique that can extend the inventive slot antenna 10 is to provide a choke at the back of the slot antenna 10. For instance, a generally dielectric loaded quarter wavelength coaxial sleeve type choke or a short circuited radial transmission form of choke can be provided to isolate the slot antenna 10 from a platform to which it is physically connected, thus reducing undesired coupling effects and making it much less sensitive to environmental presences, e.g., in a mobile handset from influence due to handset being handheld. Having selected a proper choke type, its dimensions and position can then be designed for a specific embodiment of the slot antenna 10. Alternatively, particularly in case a compact combined antenna-choke is required, the slot antenna 10 can be designed to include the effect of the choke or, in the extreme case, both can be optimized/designed together.

Returning now again to FIG. 1, this depicts an embodiment of the inventive slot antenna 10 that facilitates discussion of some design considerations. It is possible to design a linear or a generally mixed linear polarized slot antenna 10 utilizing a configuration similar to that shown. A first step is to assume two slots 30 having equal length and having the respective shortest distances to the feed 32 being substantially equal. The next step is to select some initial dimensions based on the desired frequency and the dielectric material being used.

Such dimensions can include the radius or radii of the shell 12 and the thickness of the top wall 22, the side wall 24, and the bottom wall 26 (if present). One can determine (experimentally or through simulation) other parameters to have a reasonable return loss in the desired bandwidth with or without adding a matching network. That is, for some cases, particularly when a dielectric material with high dielectric constant fills the interior region 18, it is not possible to have the proper impedance matching over the required bandwidth without using a matching network. Such parameters include the lengths of the slots 30 (which here are preferably equal), the height of the side wall 24 (i.e., the height of the slot antenna 10 itself), and the radial distance of the side wall 24 from the longitudinal axis 20 of the shell 12. Since the two slots 30 will radiate equally with the same phase, the slot antenna 10 thus designed should simply be linear polarized.

For designing a circular polarized slot antenna 10, two slightly different lengths for the slots 30 can be determined and used, instead of a single length for both. The two slots 30 can then, preferably but not necessarily, have similar shapes. Slightly different shapes can be useful, e.g., small slits can be added to the ends of one of the slots 30 to permit fine-tuning the circular polarization with relatively less sensitivity to fabrication tolerances. It should be noted, however, that changing a linear polarized design to a circular polarized one just by changing the lengths of the two slots 30 is not always possible, e.g., when a dielectric material with a very high dielectric constant is used. If the two slots 30 are not orthogonal it is still possible to have a linearly polarized slot antenna 10, but then changing the design to get circular polarization becomes more difficult.

The inventor has also observed that it is possible to select the parameters of some components so that the antenna pattern is tilted from the normal direction, particularly for circular polarization embodiments and when the slot antenna 10 is attached to a choke. One of these parameters is the shortest distance between the slots and the bottom of the slot antenna 10. The tilt angle thus obtained can typically be about 5 to 10 degrees. This is potentially useful for applications where it is desired to divert the main direction of the antenna radiation pattern in a specific direction, say, away from user's head or body.

Of course, still other prior art techniques can be applied to further extent the capabilities the inventive slot antenna 10.

FIG. 5 is a cut away view (in principle, equivalent to the cross-sectional view along section A-A of FIG. 1) of an alternate cylindrical-shaped slot antenna 10 that is also in accord with the present invention. As can be observed, the coaxial line outer conductor 36 here actually extends to the top wall 22 at an area where the shell 12 has no conductive material. However the coaxial line inner conductor 34 extends outside the slot antenna 10 and has a U-shape that connects to the conductive material of the shell 12 on the top wall 22 at the feed point 33.

FIG. 5 also illustrates other possible distinctions from the embodiment shown in FIG. 1-2. The bottom wall can be optional, as shown by its omission here, and the coaxial line outer conductor 36 then is electrically isolated from the shell 12. The slots 30 in such an embodiment may need to be longer, but by using specific shapes, such as a helical form, the total or vertical extension of the slots 30 can be reduced.

Another variation, is to have the feed 32 pass through an inner shield 40 that forms a duct 42 for coaxial elements of the feed 32. Here as well, the feed 32 can normally, but not exclusively, have a longitudinal axis 29 that is eccentrically coaxial with the longitudinal axis 20 of the shell 12.

In electrical respects, this inner shield 40 is electrically conductive and preferably connects to the coaxial line outer conductor 36. The inner shield 40 thus performs similarly to the inner side wall of the slot antenna in the parent patent application by the same inventor (U.S. patent application Ser. No. 11/608,371 listed above in the Cross-Reference To Related Applications section). As can be seen by comparison with FIG. 6 (background art), however, the present inner shield 40 is physically much different than the inner side wall of the earlier slot antenna. This leads to mechanical advantages in fabrication of the present slot antenna 10 (discussed below).

It has been the present inventor's observation that the inventive slot antenna 10 can be manufactured using many well-known fabrication methods. In particular, without limitation, manufacturing here can be easy and result in high product yield and quality, and thus be economical. The slots 30 can, for instance, be formed initially as part the shell 12, e.g., by casting, or they can be cut or etched in later. Similarly, if provided, the inner shield 40 can be formed initially with the shell 12; or vice versa, being a starting point that a dielectric material is placed on and that the shell 12 is latter added to define the interior region 18 there between; or the inner shield 40 can be attached later, e.g., by soldering. In many embodiments air can simply be the dielectric material in the interior region 18. In other embodiments, a dielectric material can be introduced to the interior region 18 and allowed to solidify. And to the extent that any such material exits at already existing openings it can be wiped away while still liquid or easily machined off once hardened. In yet other embodiments, a solid-material interior region 18 can be the basis for applying the conductive outer shell 12, e.g., by casting, spraying/sputtering, etc. Then the slots 30 can be cut or etched into their final form.

If desired, the impedance of the slot antenna 10 can be matched to equipment to which it is connected. That is, the source impedance of the slot antenna 10 to be transformed to or close to a required load impedance presented by such equipment, typically 50 ohms.

Many well-known prior art approaches can be used for this purpose. For example, a quarter wavelength transformer can be used, where a quarter wavelength transmission line, here the coaxial feed 32, with a predetermined characteristic impedance is placed between the feed point 33 and the equipment. Another useful prior art approach is reactive matching, where a reactive component, e.g., a capacitor or an inductor, either discreet or in the form of a grounded or an open stub, is placed in series or parallel to a piece of a transmission line that is directly connected to the feed 32. A more compact approach, with better performance, is to use a matching network, placed preferably but not necessarily, at the feed point 33. Alternatively, this can be placed even at the bottom 16 of the slot antenna 10. For instance, it can be placed inside the shell 12 or even outside of the slot antenna 10 or even after the choke, when it exists. Such matching networks can be embodied completely or partially in generally multilayer printed circuit boards. If such a matching board is used, it can then be located outside the slot antenna 10, preferably extending laterally from the feed 32 and have its elements connecting to the coaxial line inner conductor 34 and the coaxial line outer conductor 36, and to the shell 12 at the top wall 22.

FIG. 7 is a schematic diagram of an equivalent circuit for a suitable matching network 50 for this (the circuit here is sometimes termed an "L-match network"). The characteristic impedance is represented by an inductor 52 placed in series with the coaxial line inner conductor 34 and a shunt capacitor 54 placed between the coaxial line inner conductor 34 and the coaxial line outer conductor 36. The inductor 52 and the capacitor 54 may, either or both, be discrete components or may be embodied as electrically conductive tracks and traces on a circuit board.

While various embodiments have been described above, it should be understood that they have been presented by way of example only, and that the breadth and scope of the invention should not be limited by any of the above described exemplary embodiments, but should instead be defined only in accordance with the following claims and their equivalents.

What is claimed is:

1. An antenna having defined a top, a bottom, and a longitudinal axis, the antenna comprising:

an outer shell of electrically conductive material which is coaxial with the longitudinal axis, wherein said shell includes an outer top wall joining with an outer side wall that extends toward the bottom of the antenna;

said shell defining an interior region that is filled with dielectric material;

said shell having at least one slot with opposed slot ends, wherein each said slot extends from one said opposed slot end in said side wall and at least partially across said top wall to another said opposed slot end; and a coaxial feed extending from the bottom of the antenna to the top of the antenna, to convey electromagnetic energy to or from said top wall of the antenna.

2. The antenna of claim 1, wherein said dielectric material is inhomogeneous.

3. The antenna of claim 1, wherein:

said feed has a coaxial line outer conductor, a coaxial line inner conductor, and a coaxial line dielectric between said coaxial line outer conductor and said coaxial line inner conductor; and said coaxial line inner conductor terminates at a feed point by electrical connection to an interior side of said top wall.

4. The antenna of claim 1, wherein:

said feed has a coaxial line outer conductor, a coaxial line inner conductor, and a coaxial line dielectric between said coaxial line outer conductor and said coaxial line inner conductor; and said coaxial line inner conductor extends though said top wall and terminates at a feed point by electrical connection to an exterior side of said top wall.

5. The antenna of claim 4, wherein said feed passes though an inner shield of conductive material separating said coaxial line outer conductor from the interior region of the antenna.

6. The antenna of claim 1, further comprising a matching network.

7. The antenna of claim 1, wherein said shell has cylindrical shape such that said side wall is curved circumferentially around the longitudinal axis.

8. The antenna of claim 7, wherein said top wall is orthogonally disposed about the longitudinal axis such that said top wall is nominally flat.

9. The antenna of claim 7, wherein portions of at least one said slot extends parallel with the longitudinal axis in said side wall.

10. The antenna of claim 1, wherein portions of at least one said slot extends coplanar with the longitudinal axis in said side wall.

11. The antenna of claim 1, wherein portions of at least one said slot extends linearly and non-coplanar with the longitudinal axis in said side wall.

12. The antenna of claim 1, wherein portions of at least one said slot extends non-linearly and non-coplanar with the longitudinal axis in said side wall.

13. The antenna of claim 12, wherein portions of at least one said slot in said side wall meander.

14. The antenna of claim 1, wherein:

said slots are defined to have widths; and portions of at least one said slot has differing said widths in said side wall.

15. The antenna of claim 1, wherein said shell includes at least two said slots that cross in said top wall at the longitudinal axis.

16. The antenna of claim 15, wherein at least two said slots have different lengths.

17. The antenna of claim 15, wherein said plurality of at least two said slots are equally radially disposed with respect to the longitudinal axis.

18. The antenna of claim 1, wherein at least one said slot end is in said top wall.

19. The antenna of claim 1, wherein said shell further includes an outer bottom wall of electrically conductive material, wherein said bottom wall closes said interior region at the bottom of the antenna.

20. The antenna of claim 19, wherein said bottom wall is orthogonally disposed about the longitudinal axis such that said bottom wall is nominally flat.

* * * * *